US007946418B1

(12) United States Patent
Cerynik

(10) Patent No.: US 7,946,418 B1
(45) Date of Patent: May 24, 2011

(54) VENTILATED CASE FOR HOLDING AND ORGANIZING PAINTBRUSHES

(76) Inventor: Douglas L. Cerynik, Wynnewood, PA (US)

( * ) Notice: Subject to any disclaimer, the term of this patent is extended or adjusted under 35 U.S.C. 154(b) by 259 days.

(21) Appl. No.: 11/901,877

(22) Filed: Sep. 20, 2007

(51) Int. Cl.
*B65D 83/10* (2006.01)
*B65D 25/04* (2006.01)
*A47B 81/02* (2006.01)

(52) U.S. Cl. ..... 206/362; 206/350; 211/66; 220/533

(58) Field of Classification Search ..... 206/350, 206/362, 372–373; 211/65–66; 220/532–533
See application file for complete search history.

(56) References Cited

U.S. PATENT DOCUMENTS 1,667,044 A * 4/1928 Oddo ..... 206/362
2,290,769 A * 7/1942 Schriner ..... 422/300
3,491,986 A * 1/1970 Plett ..... 220/532
3,525,429 A * 8/1970 Vaughn ..... 206/362
3,982,631 A * 9/1976 Kunik et al. ..... 206/350
4,396,121 A * 8/1983 Lemmon ..... 220/532
4,436,215 A * 3/1984 Kleinert et al. ..... 220/533
5,381,964 A * 1/1995 Reyna ..... 239/566
5,797,489 A 8/1998 Baker

* cited by examiner

*Primary Examiner* — Bryon P Gehman
(74) *Attorney, Agent, or Firm* — LaMorte & Associates P.C.

(57) ABSTRACT

A case assembly for holding a selection of paintbrushes of the type having bristles bound to a handle with a metal band. The case assembly has ventilation openings that provide ventilation to the interior of the case. A support board is provided that is sized to fit within the interior of the case. At least one magnet is coupled to each support board. Each magnet attracts the metal bands of the paintbrushes, therein attaching the paintbrushes to each support board. By attaching the paintbrushes to the support boards with magnetism, the bristles of the paintbrushes remain unconfined. Furthermore, the paintbrushes can be attached in any orientation, such as a bristle-down orientation. This prevents water from gathering near the metal bands of the paintbrushes and causing rust.

11 Claims, 5 Drawing Sheets

VENTILATED CASE FOR HOLDING AND ORGANIZING PAINTBRUSHES

BACKGROUND OF THE INVENTION

1. Field of the Invention

In general, the present invention relates to tool cases that are designed to hold tools in an organized manner. More particularly, the present invention relates to tool cases that hold paintbrushes of various types and sizes.

2. Prior Art Description

Paintbrushes have been in existence for thousands of years. In this long history, paintbrushes have been made in a countless number of styles. In modern times, paintbrushes are typically comprised of three parts. Those parts include the handle, the bristles and the metal band that binds the bristles to the handle.

Even though most all paintbrushes contain handles, bristles and bands, the quality of these components vary widely. A paintbrush with a two-inch wide span of bristles can vary in price between one dollar and twenty dollars, depending upon the quality of the parts used in the construction of the paintbrush. Inexpensive paintbrushes are often used only once and are discarded. However, high quality paintbrushes may be used by a painter for years. High quality paintbrushes have a large number of synthetic bristles that hold a good volume of paint when dipped into paint. Although the bristles pick up paint well, the paint does not readily bond to the bristles. The paint can therefore be removed from the bristles by washing the paintbrush in water or another appropriate solvent.

If a paintbrush is not washed immediately after it is used, the paint may dry on the paintbrush. Regardless of the quality of the paintbrush, dried paint is nearly impossible to remove from brush bristles and the paintbrush becomes ruined.

Painters often change paintbrushes as they paint different colors or move to different surfaces during a job. Accordingly, a painter then must often wash paintbrushes so that the paintbrushes can be used again. Typically, a painter stores used paintbrushes in a paint pail or a box. When stored in such a manner, however, the paintbrushes can become damaged. If stored improperly, the bristles of the paintbrush may lay bent as they dry. This may create permanent deflections in the bristles of the paintbrush. Furthermore, a poorly stored paintbrush can be contaminated with dust, dirt and other debris. This foreign material mixes with the paint when the paintbrush is next used, causing a poor finish in the paint. Lastly, if a paintbrush is not provided adequate ventilation as it dries, water from the wet bristles may collect upon the metal band that holds the bristles in place. This often causes the metal band to rust. The rust then runs into the paint when the paintbrush is next used', thereby causing unsightly streaks in the paint.

In the prior art, organizational cases have been created to hold paintbrushes. However, the cases and paintbrushes are sold as a unit together, with the case being shaped to specifically hold only certain paintbrushes. Consequently, there is no room in the case for a paintbrush that was not sold with the case. Furthermore, such cases have compartments that are shaped to hold specific brush types. Consequently, a brush has to be placed back into its appropriate compartment each time. This makes such prior art brush cases difficult and impractical to use. Such prior art paintbrush cases are exemplified by U.S. Pat. No. 5,797,489 to Baker, entitled Paintbrush Case.

Furthermore, in prior art paintbrush cases, the individual paintbrushes are held in confined compartments. This close confinement prevents the bristles of the brush from rapidly drying. Additionally, the compartments typically hold the paintbrushes in a bristle up position, which prevents water from dripping out of the bristles. Both the close confinement and the bristle-up orientation tends to cause water to collect at the metal band of the paintbrush and cause rust.

A need therefore exists in the prior art for a paintbrush case that can hold a wide variety of paintbrushes of any shape and from any manufacturer, wherein the brushes can be quickly and easily added to, or removed from, the storage case. A need also exists for a case that enables paintbrushes to dry bristles-down while being protected from dust and other debris. These needs are met by the present invention as described and claimed below.

SUMMARY OF THE INVENTION

The present invention is a case assembly for holding a selection of paintbrushes of the type having bristles bound to a handle with a metal band.

The case assembly utilizes a portable case that defines an interior. The portable case has at least one hinged opening that can be selectively opened to provide access to the interior. At least part of the case defines ventilation openings that provide ventilation to the interior of the case.

At least one support board is provided. Each support board is sized to fit within the interior of the case and is selectively removable from the interior of said case.

At least one fastener is coupled to each support board. The preferred form of the fastener is a magnet. Each magnet attracts the metal bands of the paintbrushes, therein attaching the paintbrushes to said support board. By attaching the paintbrushes to the support boards with magnetism, the bristles of the paintbrushes remain unconfined. The bristles therefore received good ventilation and dry rapidly. Furthermore, by attaching the paintbrushes to the support board with magnets, the paintbrushes can be attached in any orientation, such as a bristle-down orientation. This prevents water from gathering near the metal bands of the paintbrushes and causing rust. The bristle-down orientation also prevents gravity from spreading the bristles as they dry.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention can be used to hold many types of paintbrushes, such as artist paintbrushes, the present invention is particularly well suited for holding contractor paintbrushes of the type used to paint window trim and walls of buildings. Accordingly, the exemplary embodiment of the present invention will be illustrated and described holding paintbrushes used by a paint contractor in order to set forth the best mode contemplated for the invention. However, the selected embodiment is merely exemplary and should not be considered a limitation on the scope of the claims.

Figure 1:
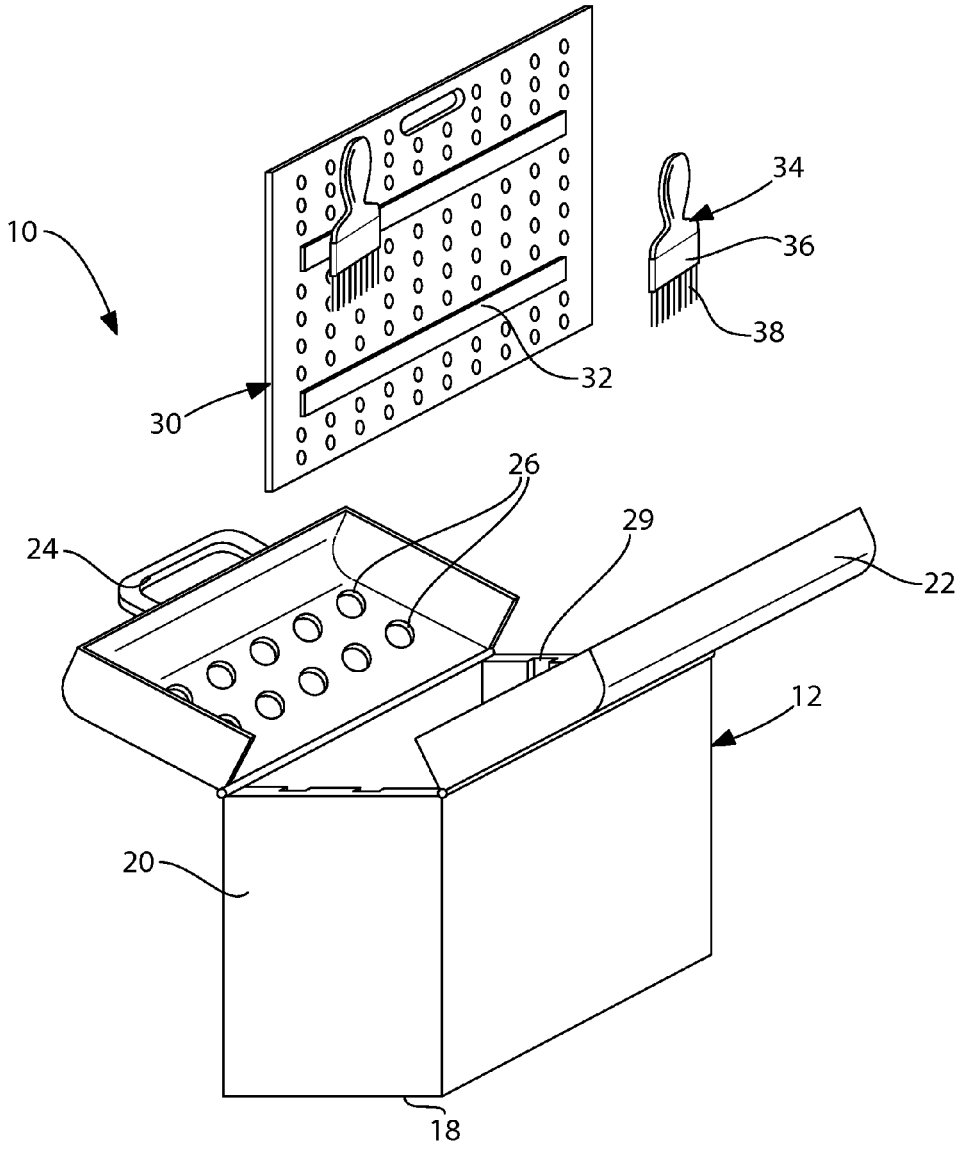
FIG. 1 is an exploded perspective view of an exemplary embodiment of a paintbrush case assembly.
Figure 2:
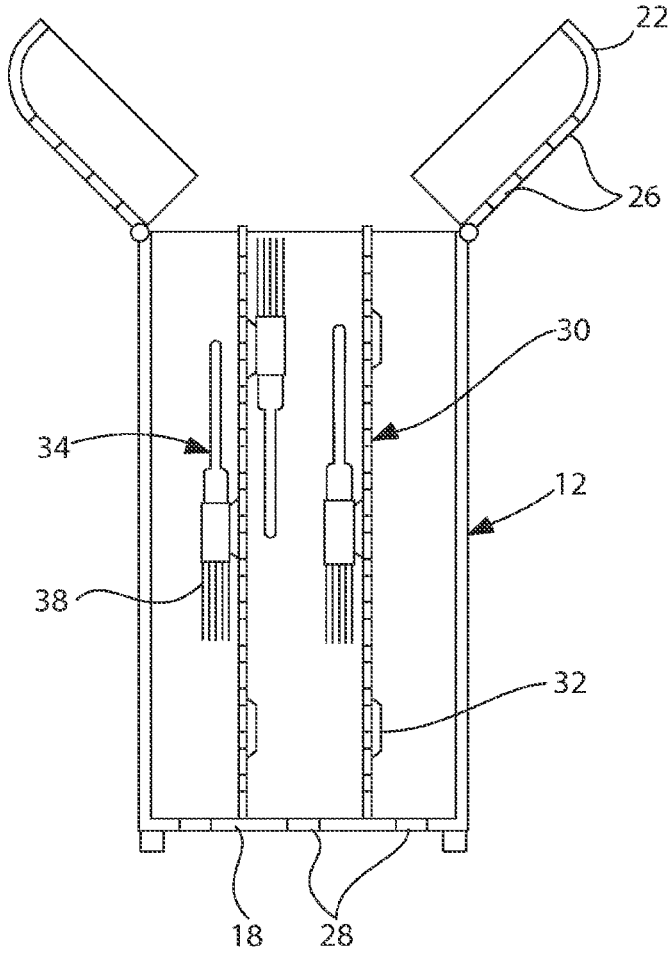
FIG. 2 is a side cross-sectional view of the exemplary embodiment.

Referring to FIG. 1 in conjunction with FIG. 2, a paintbrush case assembly 10 is shown. The paintbrush case assembly 10 contains a portable case 12. The case 12 defines an enclosed interior 14. The case 12 has a hinged opening 16 that enables the case 12 to be selectively opened and closed. The case 12 is preferably made of plastic or another material that is hydrophobic. The case 12 has a flat bottom surface 18 that enables the case 12 to be free standing. The case 12 also has vertical side walls 20 and a top surface 22. A handle 24 is attached to the top surface 22 of the case 12 to facilitate the carrying of the case 12.

Ventilation holes 26 are disposed in at least one of the side walls 20 of the case 12. The ventilation holes 26 enable air to flow into the case 12 when the case 12 is closed. This prevents water vapor from gathering inside the case 12.

Optional drain holes 28 can be disposed in the bottom surface 18 of the case 12. The drain holes 28 allow any liquid that falls to the bottom of the case 12 to exit the bottom of the case 12.

Slots 29 are formed in some of the interior side walls of the case 12. The slots 29 receive the edges of support boards 30. The support boards 30 are rigid or semi-rigid boards that are sized to just fit into the case 12. The support boards 30 are perforated and are preferably made from hydrophobic material, such as plastic. Magnetic strips 32 are attached to both sides of each of the support boards 30. Although magnetic strips 32 are used, it should be understood that the magnetic strips 32 can be replaced with a line of individual magnets.

Figure 3:
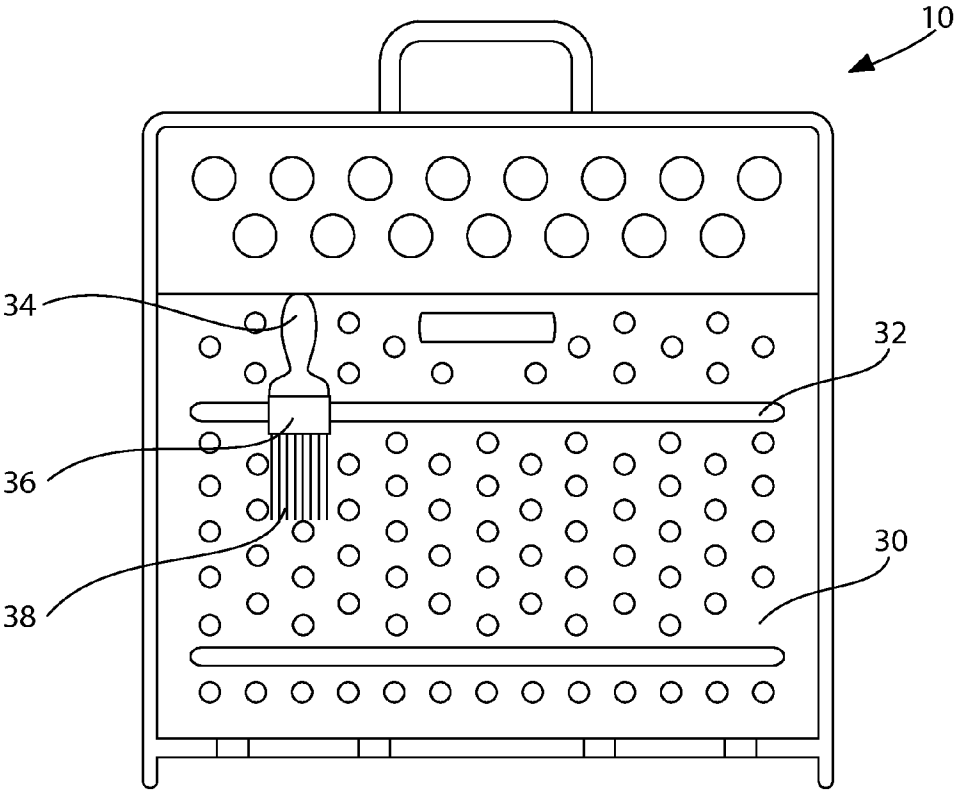
FIG. 3 is a front fragmented view of the exemplary embodiment.

Referring to FIG. 3 in conjunction with FIG. 1, it can be seen that paintbrushes 34 are attached to the magnetic strips 32 on the support boards 30. The magnetic strips 32 magnetically attract the metal bands 36 on the paintbrushes 34 and hold the paintbrushes 34 flush against the support boards 30. Any number of paintbrushes 34 in any size can be attached to the support boards 30. The only limitation being the dimensions of the support board provided. Furthermore, the paintbrush 34 can be attached to the support boards 30 either right side up or upside down. Once a paintbrush 34 is attached to the support board 30, the bristles 38 of the paintbrushes 34 are not confined on any side except the side that touches the support board 30. The support board 30 is perforated. Therefore, even the side of the bristles 38 that are present against the support board 30 are exposed to air. By not confining the bristles 38 of the paintbrush 34, wet bristles can rapidly dry, Furthermore, any water that drips from the paintbrush 34 is uninhibited and will either dry or fall to the bottom of the case 12. Water will, therefore, not collect on the paintbrush 34 and cause the metal band 36 to rust.

Referring back to FIG. 1, it can be seen that to use the paintbrush case assembly 10, the case 12 is opened and the support boards 30 removed. The support boards 30 hold a variety of paintbrushes 34. The paintbrushes 34 being held all lay flat against the support boards 30. In this manner, all the paintbrushes 34 on the support board 30 can be easily viewed. The paintbrushes 34, therefore, remain well organized for the painter.

A painter removes a selected paintbrush 34 from the support board 30 by simply pulling the paintbrush 34 away from the magnetic strip 32. The painter uses the paintbrush 34 and then cleans the paintbrush 34. The used paintbrush 34, still wet from cleaning, is then returned to the paintbrush case assembly 10 for storage. The used paintbrush 34 is attached to a magnetic strip 32 on one of the support boards 30. The paintbrush 34 is preferably attached to the support board 30 with its bristles 38 facing down. In this manner, any water that drip from the paintbrush 34 will not pass over the metal band 36 of the paintbrush 34. Furthermore, by positioning the bristles 38 down, the bristles will not spread due to the force of gravity. The support board 30 is then placed in the case 12 and the used paintbrush 34 is allowed to fully dry while protected within the case 12.

Figure 4:
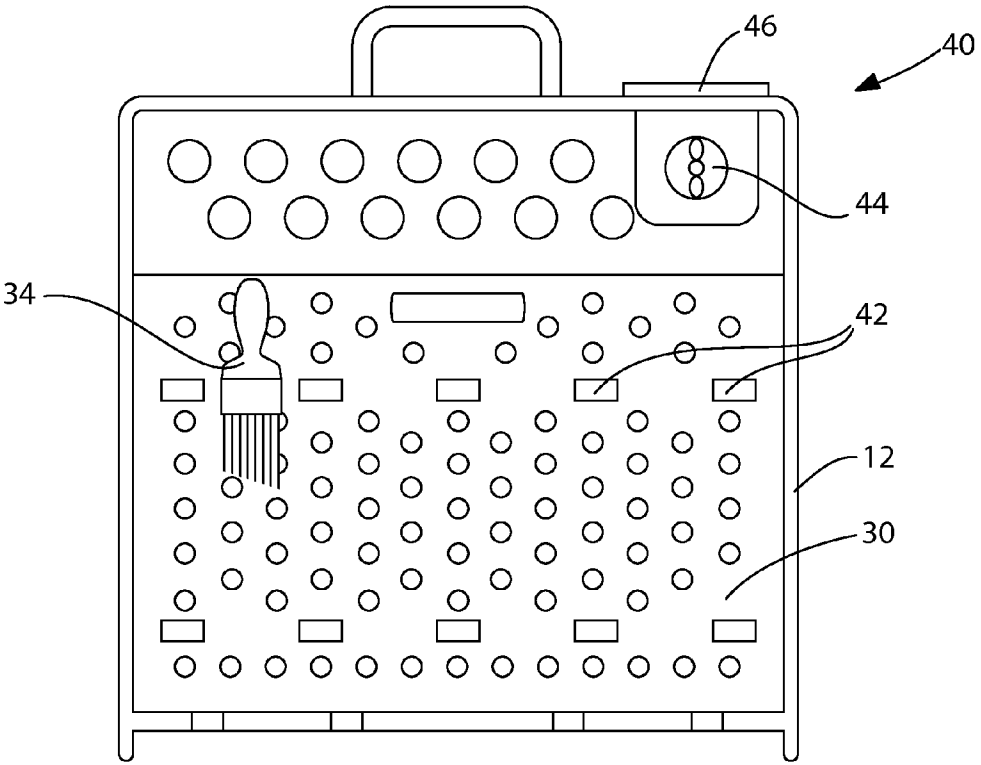
FIG. 4 is a front fragmented view of an alternate embodiment of a paintbrush case assembly.

Referring to FIG. 4, an alternate embodiment of the paintbrush case assembly 40 is shown. In this alternate embodiment. Parts identical to those of the first embodiment are identified with the same reference numbers to avoid confusion. In the embodiment of FIG. 4, an array of individual magnets 42 are affixed to the support boards 30. The array of magnets 42 provides more options as to where a paintbrush 34 can be attached to the support board 30. It also provides more flexibility as to the size of the paintbrushes 34 that can be accommodated by the support board 30. It should be understood that the use of the individually magnets can be eliminated by making the entire support board 30 magnetic.

In the embodiment of FIG. 4, a small ventilation fan 44 is provided. The ventilation fan 44 either blows air into the case 12 or draws air out of the case 12. In either scenario, a flow of air inside the case 12 is created. This actively dries the paintbrushes 34, therein reducing the amount of time it takes for a paintbrush 34 to fully dry. The ventilation fan 44 can be battery powered. In the shown embodiment, the ventilation fan 44 is run by a small solar panel 46 disposed on the side of the case 12. In this manner, a painter need only place the paintbrush case assembly 40 in a sunny location. The sun will heat the interior 14 of the case 12 while the ventilation fan 44 removes moist air from within the case 12.

Figure 5:
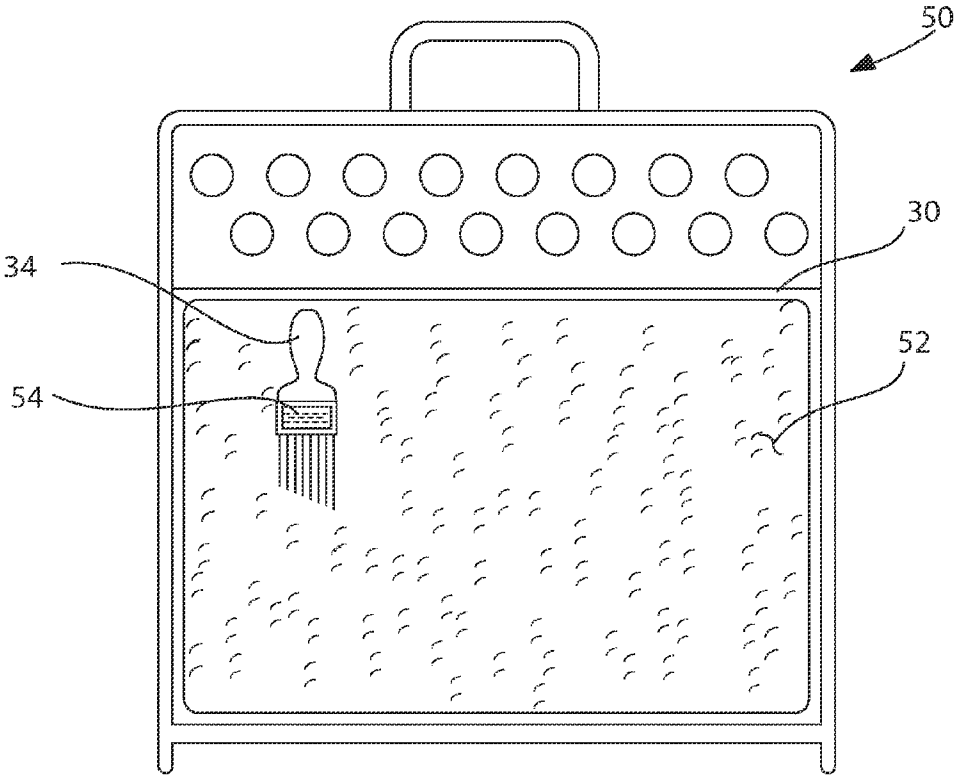
FIG. 5 is a front fragmented view of an alternate embodiment of a paintbrush case assembly.

Referring to FIG. 5, an alternate embodiment of the paintbrush case assembly 50 is shown. In this alternate embodiment. Parts identical to those of the first embodiment are identified with the same reference numbers to avoid confusion. In the embodiment of FIG. 5, the support boards 30 are covered with hook and loop fastening material 52, like Velcro™. Likewise patches 54 of hook and loop material 52 are attached to the paintbrushes 34. The hook and loop fastening material 52 provides more options as to where a paintbrush 34 can be attached to the support board 30. It also provides more flexibility as to the size of the paintbrushes 34 that can be accommodated by the support board 30.

It will be understood that the embodiments of the present invention that are illustrated are merely exemplary and that a person skilled in the art can make many variations to those embodiments. For instance, the size, and shape of the case can be altered. Furthermore, the number of support boards held inside the case can be altered. All such variations, modifications and alternate embodiments are intended to be included within the scope of the present invention as defined by the claims.

What is claimed is:

1. A case assembly comprising:

a selection of paintbrushes, wherein each of said paintbrushes has bristles bound to a handle with a metal band;

a portable case that defines an interior between opposing side surfaces, wherein said case has at least one hinged opening that can be selectively opened to provide access to said interior, and wherein at least part of said case defines ventilation openings that provide ventilation to said interior;

a ventilation fan secured within said interior of said portable case for causing air movement within said interior of said case;

slots formed in said side surfaces within said interior of said case;

a plurality of support boards, each of said support boards having perforations extending therethrough and a handle opening extending therethrough, wherein each of said support boards is sized to fit within said interior of said case, wherein each of said support boards is slidably disposed into said slots within said side surfaces, therein enabling each of said plurality of support boards to be selectively removable from said interior of said case when lifted by said handle opening; and at least one magnet coupled to a respective each of said support boards, wherein the magnets attract said metal bands of said paintbrushes, therein attaching said paintbrushes to said support board.

2. The assembly according to claim 1, wherein said case has a bottom surface and at least one drain hole is disposed in said bottom surface.

3. The assembly according to claim 1, wherein said ventilation openings are disposed in at least one of said side surfaces.

4. The assembly according to claim 1, wherein said at least one magnet is configured as a magnetic strip on said respective support board.

5. The assembly according to claim 1, wherein said at least one magnet is configured as an array of individual magnets affixed to said respective support board at different points.

6. A method of organizing and storing paintbrushes of the type having bristles bound with metal bands, said method comprising the steps of:

providing a support board having magnets disposed thereon;

providing a portable case that can receive said support board therein;

attaching paintbrushes to said support board by bringing the metal bands of said paintbrushes in contact with said magnets on said support board; and placing said support board bearing said paintbrushes into said case; and ventilating said case by moving air in said case with a ventilation fan secured within said case.

7. The method according to claim 6, wherein said step of ventilating said case includes providing ventilation openings in said case.

8. The method according to claim 6, wherein said step of providing a support board includes providing a perforated support board.

9. A case assembly for holding a selection of paintbrushes, wherein said paintbrushes have bristles bound to handles with a metal bands, said case assembly comprising:

a portable case that defines an interior, wherein at least part of said case defines ventilation openings that provide ventilation to said interior;

a fan secured within said interior of said case for moving air through said ventilation openings;

a plurality of support boards that fit within said interior of said case, said support boards being selectively removable from said interior of said case; and paintbrush fasteners disposed on each of said support boards.

10. The assembly according to claim 9, wherein said support boards are perforated.

11. The assembly according to claim 9, wherein said paintbrush fasteners are magnets.

* * * * *